United States Patent [19]

Tea

[11] 4,092,913

[45] June 6, 1978

[54] BALE TYING APPARATUS

[75] Inventor: Frank C. Tea, Bellevue, Ohio

[73] Assignee: The American Balér Company, Bellevue, Ohio

[21] Appl. No.: 463,319

[22] Filed: Apr. 23, 1974

[51] Int. Cl.[2] ..... B65B 13/04

[52] U.S. Cl. ..... 100/24; 100/31

[58] Field of Search ..... 100/31, 4, 19 R, 29, 100/24

[56] References Cited

U.S. PATENT DOCUMENTS

| | | | |
|---|---|---|---|
| 2,821,906 | 2/1958 | Stoll | 100/24 |
| 2,853,000 | 9/1958 | Russell | 100/19 R |
| 3,667,377 | 6/1972 | Persson | 100/31 |
| 3,789,751 | 2/1974 | Burford | 100/31 |

*Primary Examiner*—Harry N. Haroian

*Attorney, Agent, or Firm*—Bosworth, Sessions & McCoy

[57] ABSTRACT

Bale tying apparatus for use with a continuous extrusion reciprocating baler and comprising tie wire dispensing and guide means on opposite sides of the baler and wire pullers, twisters and cutters all on the same side of the baler. The wire pullers extend from one side to the other of the baler through slots in the baling head and engage wires on the other side and pull them to the one side and together with the wire extending therealong. The pullers position both wires adjacent the twisters and cutter. The twisters turn in opposite directions to produce twisted joints in the tie wires.

10 Claims, 16 Drawing Figures

BALE TYING APPARATUS

BACKGROUND OF THE INVENTION

This invention relates to apparatus for automatically tying bales of material formed and compacted in a continuous extrusion type baling machine. Such baling machines are old and well known in the baling art and comprise conventionally a horizontal baling chamber having sides for constraining the bale laterally and an open end of controllable cross section from which the bales are extruded, and a feed hopper opening into the top side of the baling chamber for delivering material to be baled (for example, shredded paper). A baling head reciprocates in the baling chamber past the feed hopper opening between a rearward position of retraction and a forward position of extension. The baling head conventionally is driven by a hydraulic ram.

In operation, a charge of compressible material is dumped into the hopper and passes into the baling chamber when the baling head is retracted. Successive charges are compressed and compacted together in the baling chamber and against the resistance of the material previously compressed and being extruded through the throat by repeated strokes of the baling head. In this manner a length of compacted and compressed material is formed and extruded through and out the open end of the baling chamber. When a bale; i.e., length of compressed material suitable and convenient for handling, is accumulated in the baling chamber, the bale is bound and tied with a suitable number of wires, preferably while held in a compressed state between the immediately preceding and last bale to be tied and the baling head.

Bale ties, in the past, have been placed and twisted together or otherwise secured by hand operations. For example, U.S. Pat. No. 3,024,719 discloses, among other things, a horizontal, continuous baler equipped to place blocks between the otherwise abutting ends of successively formed bales. The blocks are provided with grooves on opposite faces and extending laterally across the ends of the bales. A tie wire can be passed through the grooves and along the sides and thus around the bale being tied. Conventionally, the ends of a tie are twisted together.

Such a method of and apparatus for tying bales is slow and expensive because of the labor required and the blocks used. There has been a long-standing need for automatic tying apparatus that would operate unattended and without blocks, and which could conveniently and economically be used as something of an accessory to a conventional horizontal continuous baler. Past attempts at providing such an automatic tying apparatus have only partially satisfied the need. Some of these attempts have been in connection with agricultural balers. The problems encountered there are not the same as in the industrial type baler application. For example, the forces applied to compress hay and the like are typically much less than those encountered in large industrial baling machines. Also, tying apparatus on agricultural balers must usually accommodate the necessity for trailering the equipment during operation. Such a hay baler with tier is described in U.S. Pat. No. 2,585,425.

Automatic tiers for industrial type balers have been proposed in the past. The apparatus described in U.S. Pat. No. 3,528,364 is typical of these. In conjunction with a generally conventional horizontal extrusion baler, material to be baled is compressed and accumulated in a baling chamber and against loops of tie wire which extend back along the sides of the bale being formed to wire supplying reels located on each side of the baler.

Extending laterally out from one side of the baler, generally at the forward most position of the baling head, a substantial auxiliary structure is provided for carrying a loop of the wire lying against the one side of a bale just completed across the baling chamber to the other side and to the wire lying therealong. The wire carrier or needle is extended through open sided slots in the face of the baling head while it is in its forward most position.

On the other side of the bale another auxiliary structure standing beside and extending out from the baler comprises means for twisting together the two adjacent parts of each wire passed around the bale and for cutting the twisted wires from the supply reels with a loop through the baling chamber remaining against which the next bale will be formed.

Such apparatus has serious shortcomings and disadvantages. For example, automatic wire tying apparatus of the type described above preempts a substantial amount of floor space over and above that required for the baler itself because of the structures which extend laterally out from both sides of the baling machine. A further disadvantage results from the opposite-side arrangement of the two parts of the tying apparatus in that a baler utilizing it cannot be located close to a wall as is typical of baler locations, since the tying apparatus on both sides of the baler must be provided floor space for itself and for servicing it.

Installation of the opposite-side type tier apparatus is complicated by the need for accurately aligning and relating the two spaced and separate parts to each other and to the baler if even modestly successful operation is to be achieved. Installation is expensive and time consuming involving floor supports on both sides of the baler, and the chances for operational failures due to misalignment are increased.

Another disadvantage of the opposite-side arrangement grows out of the substantial amount of loose material being baled that escapes from the machine during baling and lodges in and on the mechanism. The open sided slots in the baling head through which the needles and wire loops must be pushed from one side of the baling chamber to the other obviously become congested with loose material being baled as the baling head is pressed into each charge of material. Thus, in the opposite-side apparatus described above, each needle as it passes through its associated slot in the baling head carrying a loop of wire to the opposite side, must clear the groove ahead of it of the loose material packed therein and then discharge the material on the wire positioning, twisting and cutting mechanism. This debris tends to prevent the free and smooth operation of the tying and cutting mechanism.

A further disadvantage of past tying machines relates to the manner of joining the ties together and to the resistance of the joints to becoming undone. It will be noted that each completed tie placed around a bale by apparatus having a wire supply on both sides of the baler as described above, has two joints in it. One is near a front corner of the bale and joins the ends of the wires on each side of the bale to form a loop passing in front of the bale being formed. The other is near a rear corner of the bale and joins together the two wires passing around the bale. The joint at the after corner of one bale and at the forward corner of the succeeding bale are formed at the same time and severed by a cutter. It is common practice to twist the forward and after joints the same relative direction. Thus, the twisting action producing an after joint is in a direction which tends to untwist the previously twisted forward joint.

BRIEF SUMMARY OF THE INVENTION

This invention, by its unique structure and arrangement of elements and functions, overcomes the disadvantages of prior apparatus described above and provides a mechanically and economically desirable and improved apparatus for automatically tying bales produced by an extrusion-type baler. Briefly, the apparatus embodying this invention and for use with a baler including a baling chamber having sides, a feed hopper having an opening into the chamber for delivering material to be baled, a baling head reciprocable within the chamber past the feed hopper opening to a forward position of extension and means such as a hudraulic ram for reciprocating the head, comprises wire dispensing means including wire guide means, a wire carrier, a twister or joint forming means and a cutter.

The wire dispensing and guide means include, for example, reels or spools and guide arms provided on opposite sides of the baler. The wire dispensed from them extends between them and through the baling chamber on the forward side of the feed hopper opening, and back along each side of the chamber as a bale is formed therein.

The wire carrier or wire puller is located on one side of the baler and includes means for extending and retracting it through the slots in the baling head and across the chamber to and from the other side from the one side, a nose for engaging the wire extending along the other side whereby retraction of the wire puller pulls wire from the dispensing means on the other side across the chamber and positions a length of the wire drawn from the other side closely adjacent a corresponding length of wire on the one side and in operative relationship to the twisters and cutters referred to below.

A pair of rotatable twister means spaced apart from each other are located on one and the same side of the baler as the wire puller and the means for reciprocating it. The twister means are arranged for engagement with the lengths of wires positioned adjacent each other by the wire carrier and they include means for rotating them whereby the wires are twisted together for a distance from the point of engagement of each twister means.

The cutter means is also located on one and the same side of the baler as the wire carrier and its reciprocating means and as the twister means. The cutter operates in a space between forward and after twisters of the twister means and cuts both wires between the forward and after twisted joints.

It will be seen that in the apparatus embodying this invention that substantially all the elements of the automatic wire tier are stationed on the same side of the baler. The wire carrier, twister means, and cutter can all be incorporated in single structure supported on a common base. The apparatus thus uses a minimum of floor space and the baler can be located with its other side from the tier apparatus spaced only a normal distance from a wall.

Integration of the wire carrier, twisters, and cutter elements in a single supporting structure eliminates the troublesome alignment problems which can result in malfunctions and interrupted operations. It also affords the obvious advantage of placing all the hydrualic and electrical connections on the same side of the baler with short runs between the interconnected elements.

Placement of almost the entire tier apparatus on one side of the baler also requires the wire pullers to be positioned in the baling head slots only a minimum of time. All the time the twisted joints are being made and the ties cut, the wire carriers are in the retracted position and out of the slots. The wire carriers only need be in the slots long enough to extend, pick up the opposite-side wire, and retract. During this time, the wire carriers are protected from damage resulting from the inadvertent retraction or movement of the baling head by a mechanical lock restraining the baling head so long as any portions of the wire pullers are in the slots in the face of the baling head.

The apparatus of this invention avoids the difficulty of trying to pull wire loops and the wire carrier through debris clogged slots in the face of the baling head because the wire carriers first push through and clean the slots without any wires attached and do so in a direction away from the twisters and cutters to discharge the debris dislodged out the side of the baler free of any tier apparatus.

The twisters preferably are rotated in opposite directions so that as an after twisted joint is made the direction of twist tends to tighten the forward twisted joint of the same tie. In addition, as will be explained in detail below, the preferred embodiment includes a twister and twister hook which produce a joint shaped to resist coming undone.

The foregoing as well as other objects and advantages of the invention will become apparent from the drawings and the detailed description which follows.

DETAILED DESCRIPTION OF A PREFERRED EMBODIMENT

Figure 1:
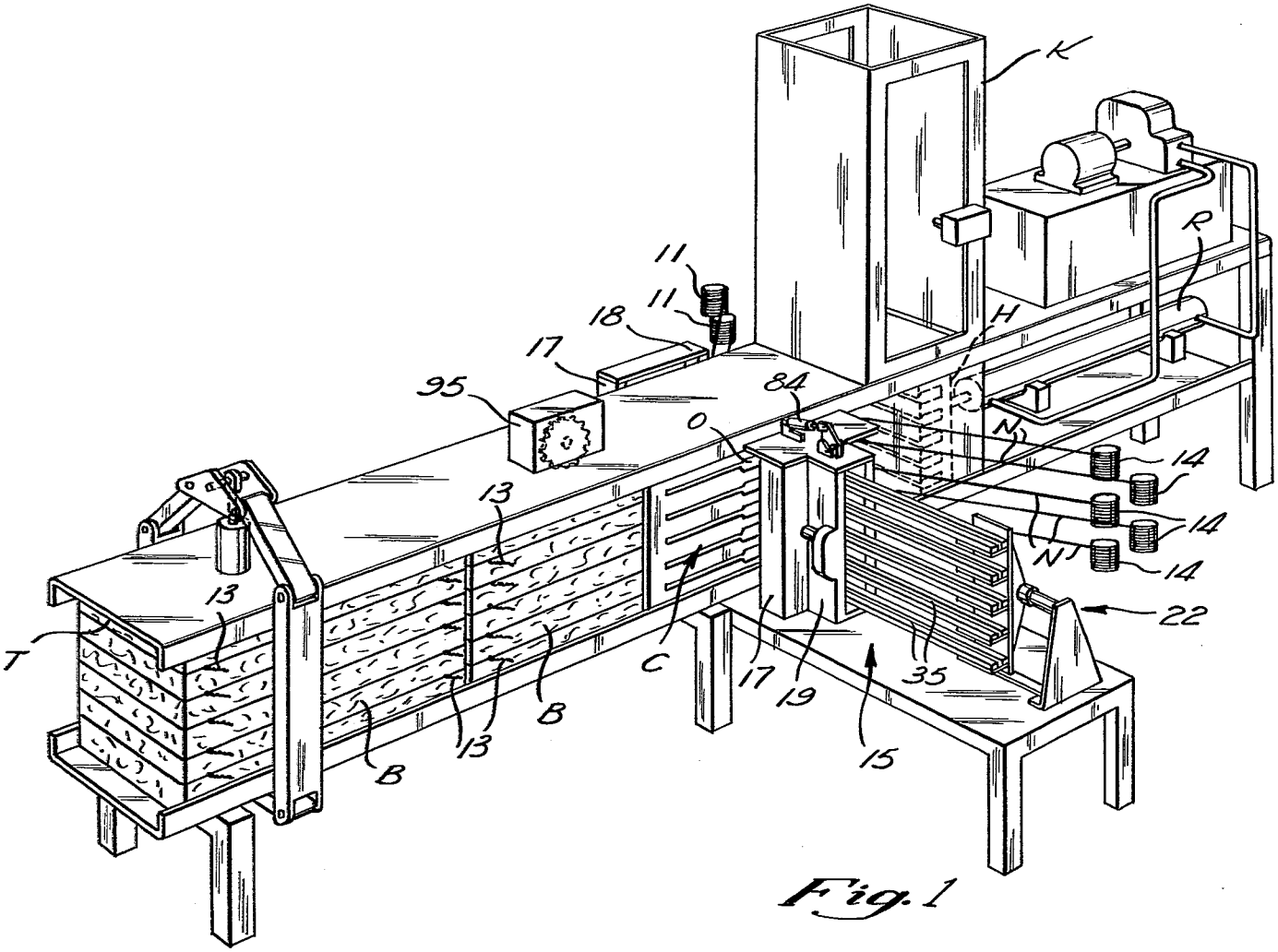
FIG. 1 is a perspective view of a conventional baling machine equipped with an automatic wire tier embodying this invention.

A preferred embodiment of this invention can be divided functionally into wire dispensing and guide means, wire pullers, twisters, and cutters. Normally, a number of parallel spaced apart ties are placed around each bale and therefore the apparatus for placing and twisting one tie appears in multiple in typical embodiments and in the preferred embodiment shown in the drawings and described below. Generally speaking, one set of apparatus for producing one tie will be described in detail and it should be understood that the other sets are similar if not the same as the one described.

Throughout the following description and claims of the apparatus embodying this invention and a baler with which it is used, the end of the baler from which the completed and tied bale is discharged and structures and motions related to and directed that way are referred to a "forward" or "front" sides and directions. Structures and motions related to and directed toward the opposite end of the baler are referred to as "rearward" or "after" sides and directions.

As mentioned earlier, all of the structure comprising the invention's embodiment except one of the two wire dispensing and guiding means are located together on the same side of the baler. The construction and operational relationship of the apparatus can best be understood with a knowledge of the operational steps involved in placing and joining a tie around a bale as it is produced by an extrusion baler. FIGS. 13 through 16 of the drawings show the steps diagrammatically as seen from above.

Figure 13:
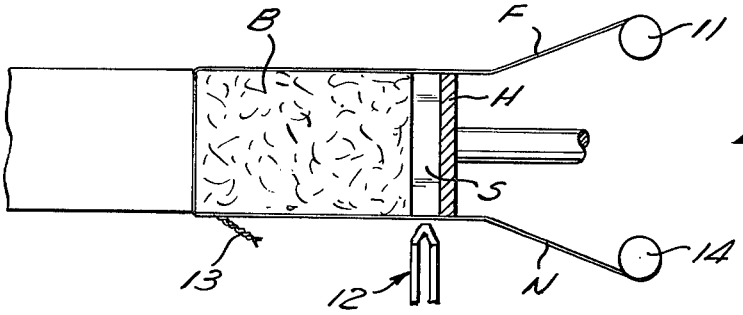
FIGS. 13, 14, 15 and 16 are diagrammatic views showing operational steps in the automatic bale tying process.

In FIG. 13, a bale B has just been completed from a number of changes of material successively compressed into the baling chamber (not shown) by baling head H. The off-side wire F comes from a reel 11 and passes along the side of the bale. Being guided and positioned by means not shown in this simplified representation. The off-side wire passes in front of the bale B and is joined to the on-side wire N near but back from the forward on-side corner of bale B. The on-side wire N passing along the side of the bale past the wire puller indicated generally at 12 to the on-side wire dispensing reel 14. The forward joint 13 of wires F and N was made at the completion of the bale immediately forward of bale B.

Figure 14:
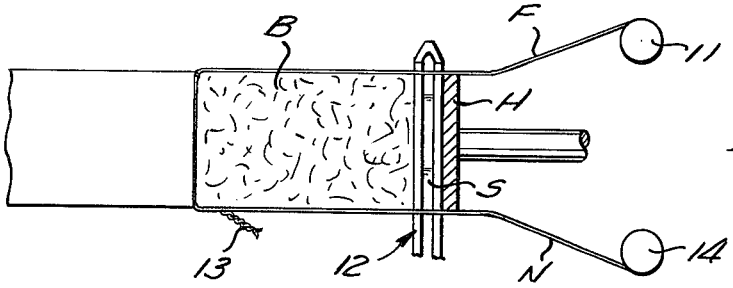

In FIG. 14, wire puller 12 is extended through a slot S in baling head H from the on-side to the off-side of the baler, having passed beneath both the on-side and off-side wires N and F. Nose 15 of wire puller 12 is beyond off-side wire F.

Figure 15:
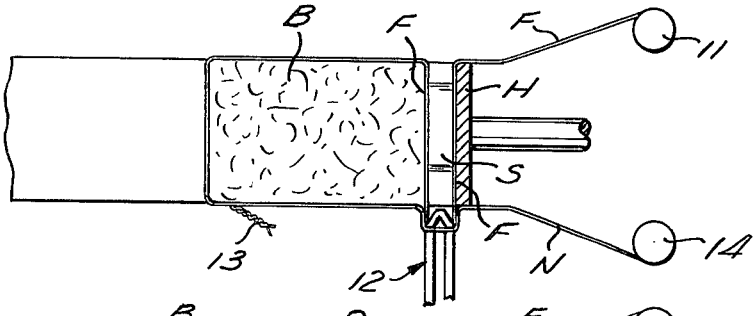

In FIG. 15, wire puller 12 has been retracted through slots S in head H. Nose 15 has engaged off-side wire F by means described fully hereinafter and pulled a loop of off-side wire F from reel 11 through slot S of the baling head and engaged on-side wire N as well, positioning a length the two wires closely adjacent and a bit removed from the normal line of on-side wire N.

Figure 16:
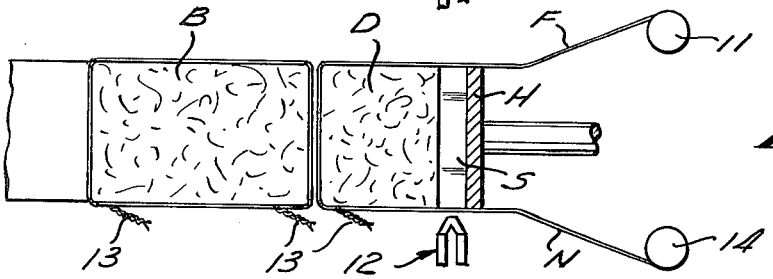

In FIG. 16, the closely adjacent lengths of off-side and on-side wires have been joined by twisting and then cut (by twisters and a cutter not shown) to make the after on-side joint in the tie about completed bale B and the forward on-side joint on the tie being positioned by the extrusion about succeeding bale D. FIG. 16 is followed by FIG. 13 with bale B of the latter becoming bale D of the former.

The general form of the apparatus embodying this invention and its relationship in use to a continuous extrusion baler is shown in FIG. 1. The baler itself comprises a baling chamber C, a feed hopper K having an opening into chamber C. Baling head H is reciprocated by hydraulic ram R to form bales from charges of material loaded into hopper K and delivered to chamber C. The material compressed by baling head H is extruded through a throat T of controllable cross sectional dimensions and out the forward end of the baler.

When the required number of charges to form a full bale have been compressed together and head H is in its forward most position, the bale is tightly compressed between head H and the preceeding bale and the resistance to its movement out of the baler provided by the friction in throat T. Openings O, corresponding in number and location to the ties to be placed around each bale, are provided in the sides of baling chamber C in line with a like number of slots S in head H when in its forward most position to accept the wire pullers 12 of the tying apparatus.

The automatic wire tying apparatus, indicated generally by 15, is positioned beside the baler approximately at the forward most position of baling head H. The apparatus comprises wire dispensing reels, off-side at 11 and on-side at 14, forward and after wire guide assemblies on both sides and indicated generally at 17, and 18, respectively, forward and after twister assemblies at the on-side only and indicated generally at 19 and 20, respectively, a cutter assembly 21 between twister assemblies 19 and 20, and a wire puller assembly 22 including the individual pullers, a carriage, and mechanism for reciprocating them during operation of the apparatus. Details of these assemblies have been omitted from FIG. 1, but are shown elsewhere in the drawings.

Figure 2:
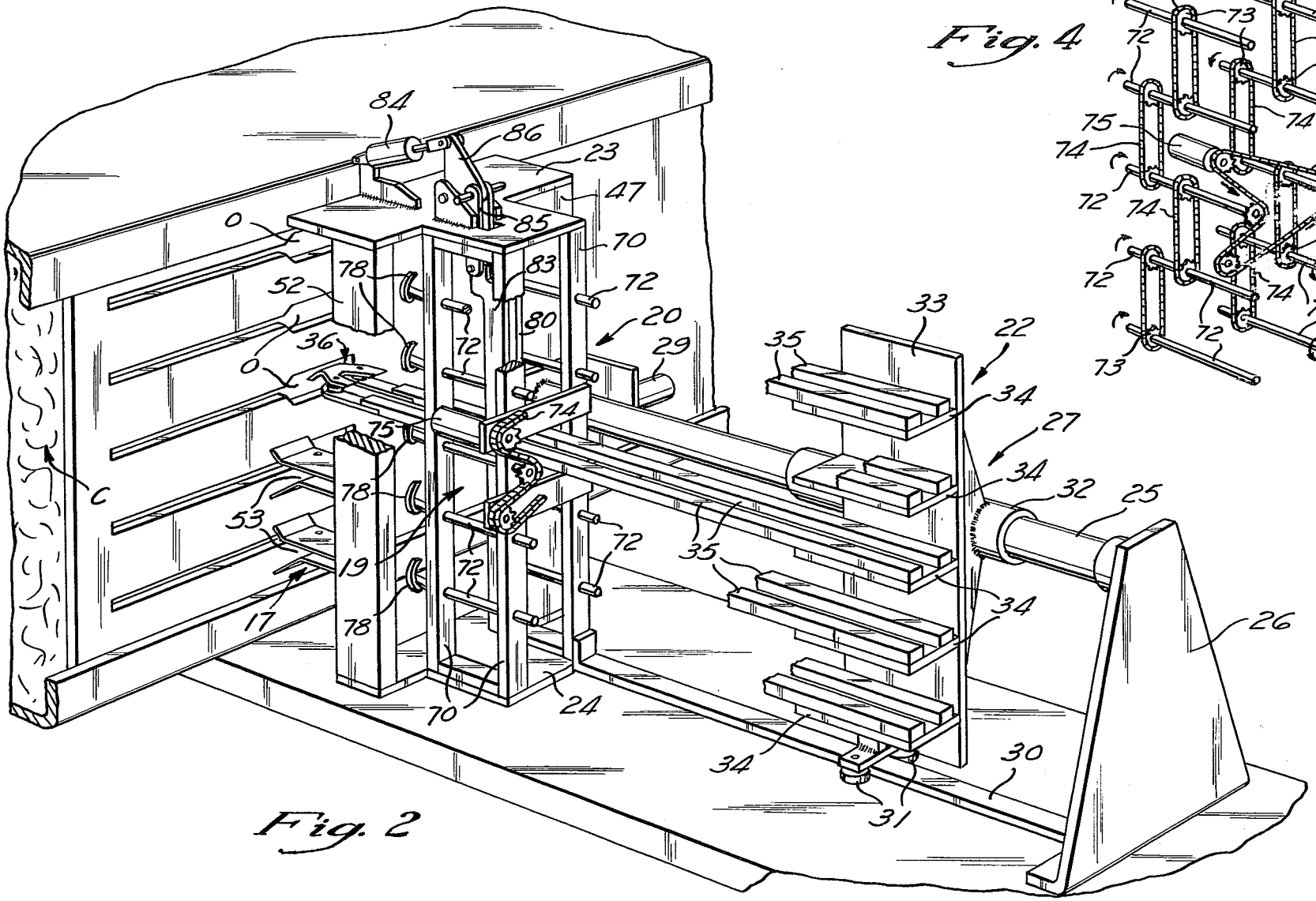
FIG. 2 is a perspective elevation of the wire tier of FIG. 1 looking from the forward end of the baler with parts broken away and adjacent portions of the baler shown for clarification.
Figures 3, 5:
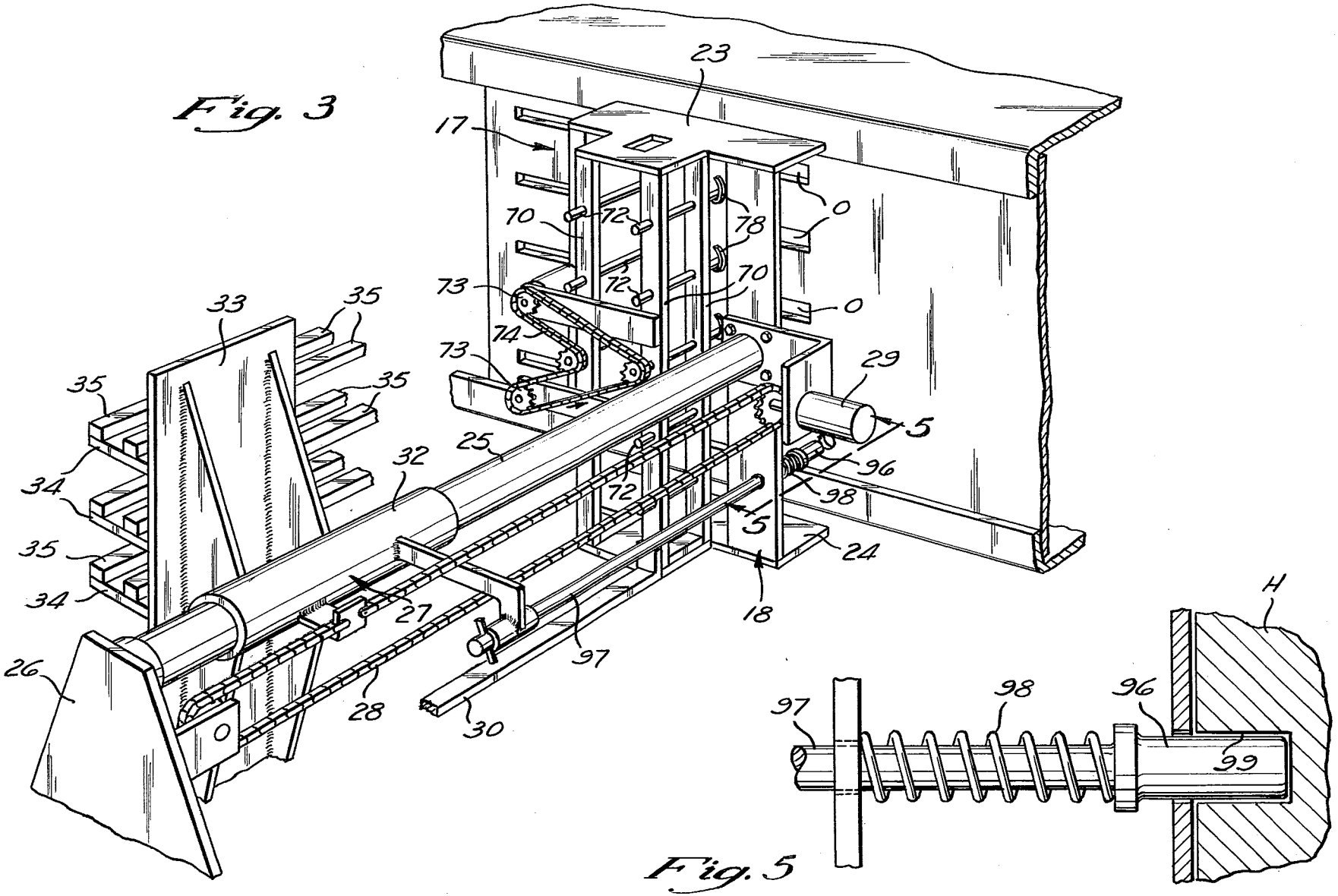
FIG. 3 is a perspective elevation of the wire tier of FIG. 1 looking from the rearward or after end of the baler and with parts broken away and adjacent portions of the baler shown for clarification.
FIG. 5 is a partially sectioned elevation of the mechanical baling head lock.

FIGS. 2 and 3 show in detail the assemblies referred to above and show in detail at least one of the multiple elements of apparatus for placing five parallel spaced apart ties on a bale. Twister assemblies 19 and 20 and cutter assembly 21 are mounted together between upper and lower end plates 23 and 24. A guide tube 25 extends outwardly from after wire guide assembly 18 and is supported between it and an end support 26. Tube 25 carries and guides a cross head 27 for reciprocating movement provided by an endless chain 28 driven by a reversible hydraulic motor 29. A guide rail 30 extends parallel to and spaced from tube 25 between after twister assembly 20 and end support 26 for guiding and orienting engagement by rollers 31 on the lower end of crosshead 27.

Crosshead 27 comprises a sleeve 32 which slides on tube 25 and carries a mounting plate 33 and five parallel spaced apart supporting shelves 34. A wire puller 12 is attached to and carried by each shelf 34 so that reciprocation of crosshead 27 through operation of hydraulic motor 29 and chain 28 extends and retracts wire pullers 12 into and through the baling chamber of the baler as described generally above.

All of the wire pullers 12 have been broken away in FIG. 3 and all but one in FIG. 2. They are identical, and the details can be seen clearly in FIGS. 6, 7 and 9 through 11. Each wire puller 12 is formed with a central slot extending longitudinally from its one end supported on a shelf 34 to a nose 36 at its other end. Preferably, two square section tubes or bars 35 are welded at their one end to their respective shelf in a parallel spaced apart relationship and joined together at their other end by a nose assembly.

Figure 9:
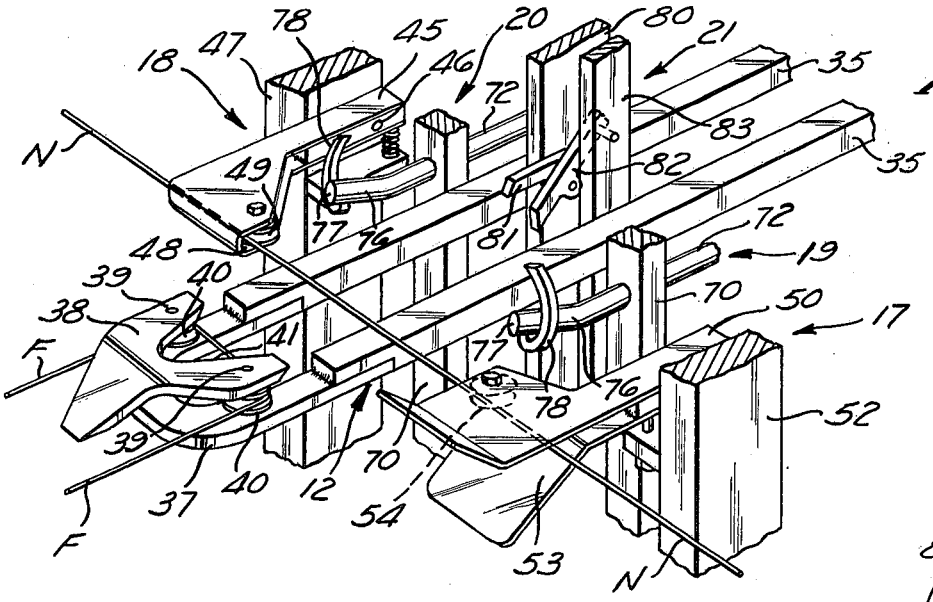
FIGS. 9, 10 and 11 are perspective elevations of a wire puller, twisters, and cutter and the tie wire showing progressively operational steps in the making of ties.
Figure 10:
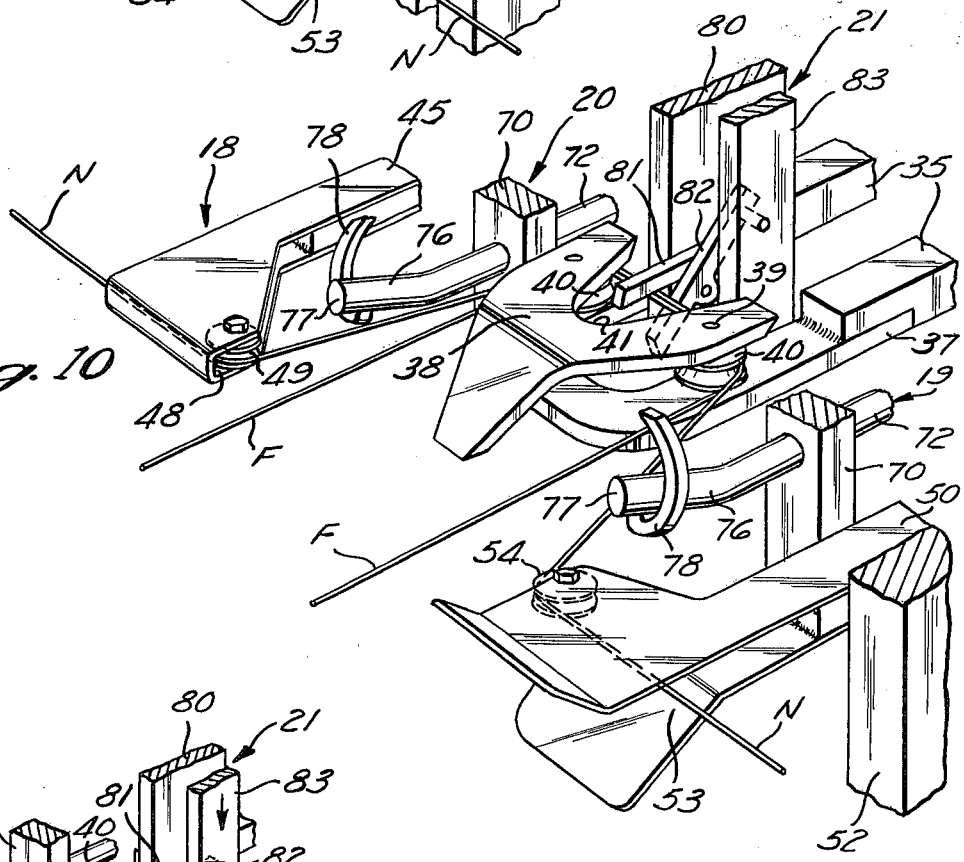

Nose assembly 36 comprises a U-shaped element 37 closing the end of the slot in wire puller 12 by joining its two sides as shown in FIGS. 9 and 10, for example. A generally triangular shoe 38 is mounted on element 37 by two pins 39 and spaced from it a distance sufficient to raise its upper surface significantly above the level of the bars 35 as clearly shown in FIG. 7. A sheave 40 is mounted for rotation on each pin 39 and between shoe 38 and element 37 for engagement of the on-side and off-side wires. The side of shoe 38 between pins 39 and sheaves 40 is provided with an open cut-out 41 and the forward vertex of triangular shoe 38 is bent downward preferably to a level below the lower surface of U-shaped element 37. The purpose of cut-out 41 and depressed end and relative levels on shoe 38 will appear hereinafter.

Figure 6:
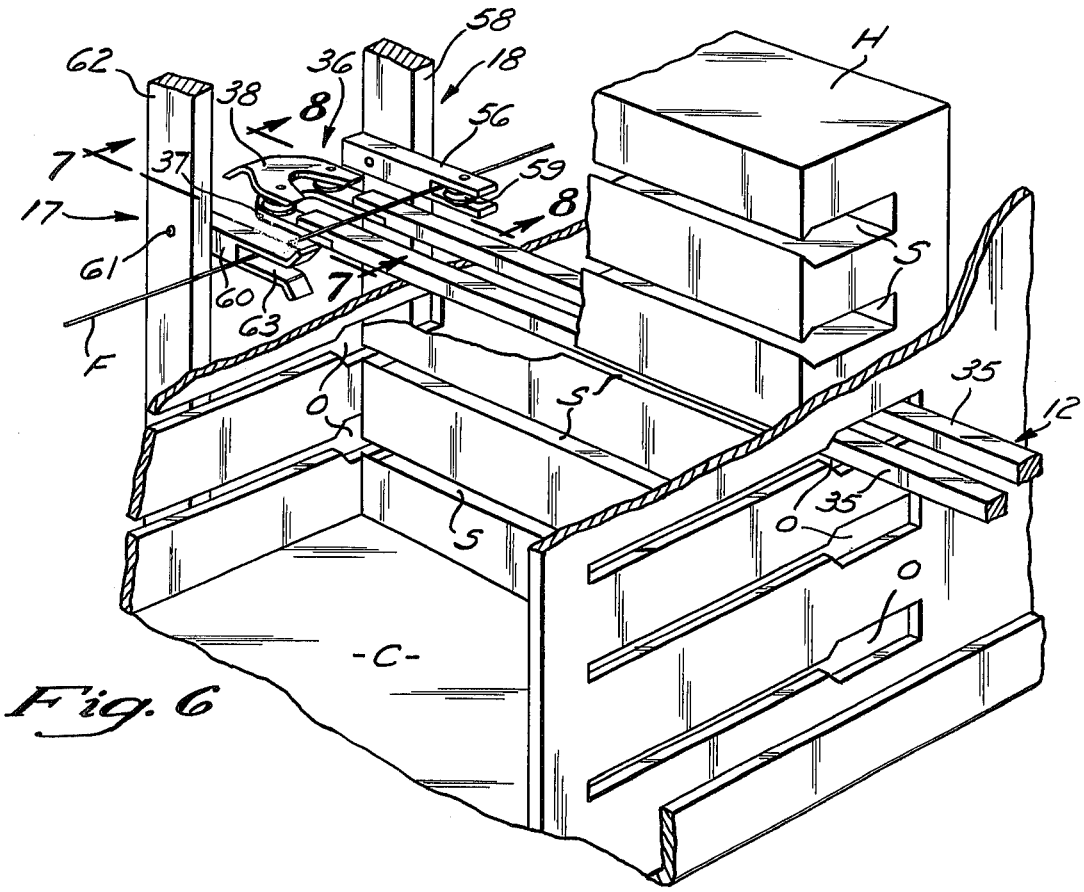
FIG. 6 is a perspective elevation in enlarged scale of a wire puller extended through a baling head slot with parts of the baler broken away.

Forward and after wire guide assemblies 17 and 18 are seen in detail in FIGS. 6, 8, 9 and 10, for example. FIG. 6 shows off-side guides and FIGS. 8 and 10, on-side. They function essentially the same. As seen in FIG. 9, for example, an after guide 18 comprises a horizontally extending arm 45 pivoted at 46 to a vertical column 47. Arm 45 extends outwardly from column 47 toward the adjacent baler and terminates in a closed slot 48 in which on-side wire N is retained and guided by a sheave 49.

Forward wire guide 17 on the apparatus side comprises a horizontally extending arm 50 pivotally connected to a vertical column 52. Arm 50 extends outwardly from column 52 toward the baler and terminates in a flared open slot 53 in which on-side wire N is retained and guided by a sheave 54.

The forward and after wire guides 17 and 18 on the off-side are essentially the same. After guide 18 comprises an an arm 56 pivoted at 57 to column 58 and terminating in a slot and sheave 59 which captures off-side wire F behind it. Forward off-side wire guide 17 comprises an arm 60 pivoted at 61 to column 62 and terminating in a flared open slot 63 for guiding off-side wire F.

Figure 8:
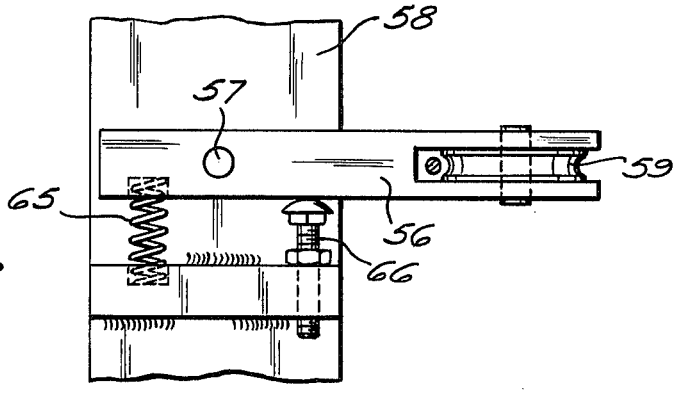
FIG. 8 is a side elevation in enlarged scale of a typical wire guide.

The detail of off-side after wire guide 18 shown in FIG. 8 is typical of the pivotal mounting of all arms 45, 50, 56 and 60 of the wire guides. As shown, the slotted end of arm 56 is free to swing upwardly against the compression of spring 65 supported on column 58. It is urged by spring 65 to a rest position adjustably determined by adjusting screw 66 also mounted on column 58.

It is understood, of course, that each tie to be placed on the bale requires at the appropriate level a forward and after wire guide on both the on- and off-sides and as individually described above. The adjustment screws associated with each permits adjustment of the levels for trouble free and convenient operational alignment of the apparatus.

In operation, the various wire guides 17 and 18 serve to hold lengths of each of the on-side and off-side tie wires adjacent the openings 0 in the sides of the baling chamber at a level which permits the nose 36 of each wire puller 12 to pass on its extension stroke beneath both the on- and off-side wires at its level. The guides also insure that the nose 36 of each wire puller will engage and pull from their respective reels both the off-side and on-side wires on its retraction stroke. The at-rest wire levels are established so that the down-turned end of each wire puller nose lies below the wire. As the wire pullers 12 are extended, each on-side and then each off-side wire engages the inclined fore part of a shoe 38 and is pivoted and lifted against its compression spring. When the elevated nose portions of the wire pullers have passed, the arms are returned to their original adjusted level by their compression springs.

Figure 7:
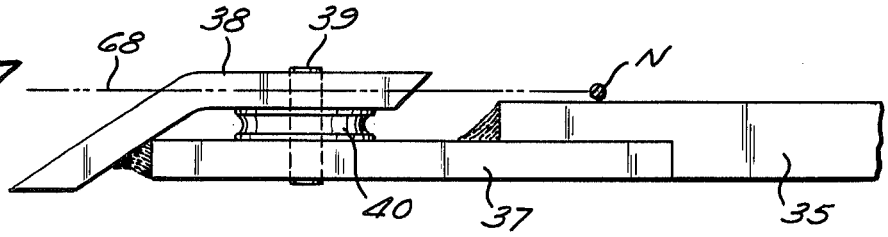
FIG. 7 is a side elevation in enlarged scale of the nose of a wire puller.

The relationships and levels involved with each tie are illustrated in FIG. 7. The center line 68 indicates the at-rest level of one wire. As shown, it is above the lowermost and forward point of shoe 38 but below the elevated after portion of the shoe. The inclined fore part raises the wire which is stiff enough to pivot the wire guide arms upwardly. Once the elevated shoe 38 has passed, the arms return the wire to its original level at about the top of the bar portion of the wire pullers 12. This condition is shown in FIGS. 6 and 7. When wire pullers 12 are retracted, the after side of shoes 38 is chamfered to guide the wire behind it under the shoe and into the grooves of sheaves 40 for easy pulling of a loop of both the off-side wire to the twisting and cutting position shown in FIG. 10. In FIG. 9, a wire puller 12 is shown partially retracted and pulling with it a loop of off-side wire F and about to engage on-side wire N.

When the wire pullers 12 have fully retracted and pulled and positioned corresponding lengths of the on-side and off-side wires N and F as shown in FIG. 10, the twisted joints are made by forward and after twister assemblies 19 and 20 and separated by cutter assembly 21.

Figure 4:
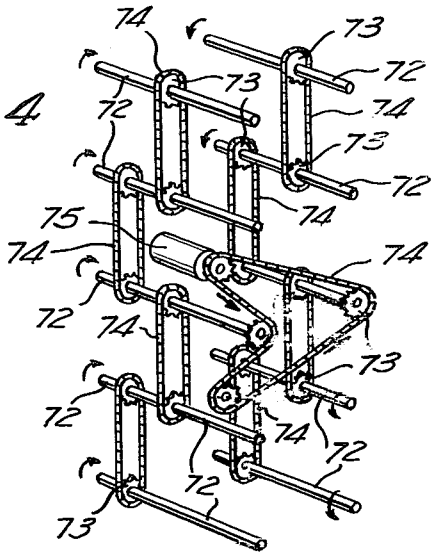
FIG. 4 is a perspective elevation of a portion of the twister drive.

Forward and after twister assemblies 19 and 20 are provided only on the on-side of the baler together with cutter assembly 21, wire pullers 12, and means for their support and activation. Forward and after twister assemblies 19 and 20 each comprise a pair of spaced vertical columns 70 standing between end plates 23 and 24 and journaling twisters for rotation. There are five pairs of twisters in the preferred embodiment, one for each tie. Each twister comprises a shaft 72 driven by a sprocket 73 mounted on the shaft and connected by chains 74 to hydraulic motor 75. The complete interconnection of all ten twisters and hydraulic motor 75 is shown in detail in FIG. 4. It will be noted that the forward and after twisters rotate in opposite directions and each set toward the other. The space between columns 70 of forward and after assemblies permits the wire pullers 12 to operate and position between them corresponding lengths of the on- and off-side wires to be twisted together.

The end portions 76 of twister shafts 72 extending beyond column 70 nearest the baler are angled slightly with respect to the shaft's axis of rotation. The end portions 76 thus each describe a cone when shafts 72 are turned, and the outer ends 77 of the end portions 76, a circle with the shaft axis extended as center. At or near the ends 77, hooks 78 are attached to and project from twister shafts 72. The curve of hooks 78 generally follows, as shown, a helical spiral about the axis of the angled shaft portion 76 from which it projects. Thus each hook 78, like the shaft portions 76 at the point of attachment of the hooks, moves in a circular path about the shaft axis extended as shafts 72 are turned.

Cutter assembly 21 stands between forward and after twister assemblies 17 and 18 and in the slot-like spaces between bars 35 of all the wire pullers 12. As shown particularly in FIGS. 9—11, the assembly comprises a stationary vertical column 80 supporting a stationary cutter bar 81 and a pivotally connected movable cutter bar 82 at each wire level. A movable link 83 pivotally connected to the ends of all movable cutters 82 and movable up and down relative to stationary column 80 is actuated by suitable means such as hydraulic actuator 84 connected to it by links 85 and crank 86. See FIG. 2.

Figure 11:
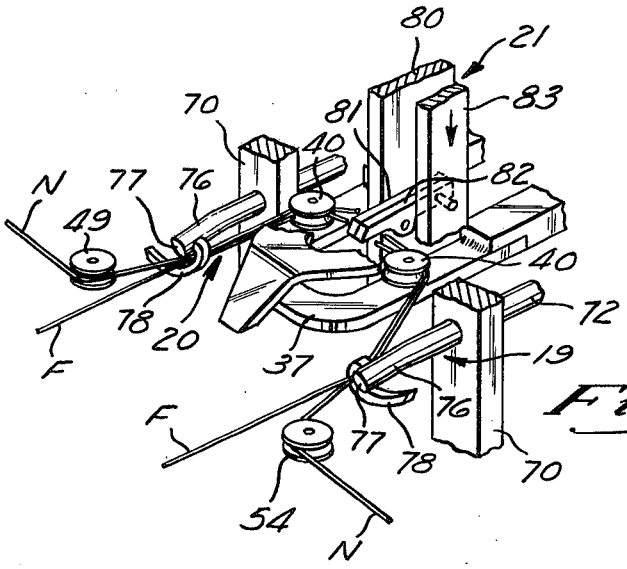

In operation of the twisters and cutter, twister shafts 72 are oriented in their idle position as shown in FIGS. 9 and 10 at all times except during the twisting operation. Thus they are clear of the wire pullers 12 and the wires being pulled during the actuation cycle of the pullers. When the wires are positioned together around the sheaves of the on-side forward and after wire guides 17 and 18 and sheaves 40 at the nose of the wire pullers 12 and are held between the open cutter blades 81 and 82 as shown in FIG. 10, hydraulic motor 75 is actuated turning all twister shafts 72 in the directions shown in FIG. 4. FIG. 11 shows the hooks and their degree of engagement with the wires after approximately only 270° of shaft rotation. The tips of each hook 78 reaches beyond the adjacent portions of the wires and draws them over to the shaft. The angled end portion 76 of each shaft is oriented so that it carries its hook toward the wires on its circular path during approximately the first half turn of the shaft. The helical spiral curve of the hooks slides the engaged wires along the hooks to their points of attachment with the shafts.

At this point in the operation of the twisters, cutter bars 82 are closed with cutter bars 81 by hydraulic actuator 84 shearing through the wires between them. FIG. 11 shows the wires just after shearing and with the twisters after approximately 270° of turn from their idle position.

Figure 12:
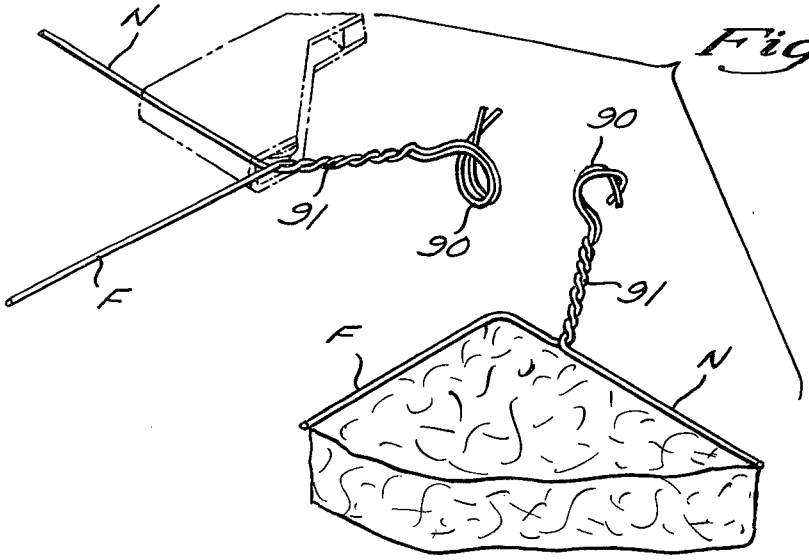
FIG. 12 shows in perspective the adjacent corners on the tie side of forward and after twisted joints formed together and cut apart.

Further rotation of each twister shaft 72 twists the wires caught by its hook progressively together beginning at their point of engagement at the junction of the respective hook and shaft. The number of twists should be enough to form a strong joint and to draw the wires together down to after wire guide 18, whose closed slot 48 prevents further tightening. See FIG. 12. The grip on the ends of the wires seems to result from a combination of the shape of the hook curving in a helical spiral from a substantially right angle junction at its point of attachment to the shaft and from the angle in the end of twister shaft 72 which carries all parts of the hook about in a circular path.

This particular hook arrangement is believed to make possible a novel and effective twister device. The hooks are preferably formed of square stock somewhat tapered on their free end. They may be attached and secured against rotation by insertion into square holes in the shafts and held there by set screws.

The angled end of the twister shafts and their associated hooks also produces a desirable and distinctive curl 90 on the end of twisted joint beyond the tightly twisted portion 91. This is clearly shown in FIG. 12. This curl helps to anchor the twisted joint into the bale when the joint is pressed against it as it progresses out the end of the baler and otherwise contributes to the resistance of the joint to opening.

Control of the apparatus can be arranged by persons skilled in the control systems art to provide for its automatic operation interconnected with the operation of the baler. Such controls per se, involving essentially sequencing of the operative elements of the tier apparatus, comprise no part of this invention. Their desired functions will be described for a full understanding of the apparatus.

Preferably, the controls are arranged so that when a bale of desired length is completed as indicated by a conventional bale length measurer (element 95, FIG. 1) baling head H advances to and stops at the tying position with slots S aligned with openings O in the sides of baling chamber C. At this position, baling head H actuates a limit switch signalling the extension of wire pullers 12. As the pullers begin to advance, they mechanically release a bolt 96 carried on rod 97 and urged by spring 98 into locking engagement in a socket 99 in baling head H. See FIGS. 3 and 5. This prevents possible damage to wire pullers 12 while captured in slots S in baling head H resulting from the backing off of the baling head for any reason.

As the wire pullers advance they raise and pass under on-side wires N, enter and clean the debris from slots S in the baling head, and raise and pass under off-side wires F. Their advance is halted by engagement with an appropriately located limit switch. A time delay may be introduced at this time to give the debris pushed from the slots an opportunity to fall away and clear of the wires and pullers.

Next the wire pullers retract pulling loops of off-side wires F through the cleaned slots S of head H, engaging on-side wires N and pulling sets of both wires between the twisters and into the cutters. This motion is halted by engagement of another appropriately located limit switch. The mechanical bolt 96 is also withdrawn from the baling head.

Activation of the last mentioned limit switch also signals the twisters and cutters to operate a preferred way of sequencing their operation so the twisters turn about 270° and securely engage the wires with their hooks before the wires are cut is to employ a cutter actuator which operates at a higher pressure than the twister motor. The cutter actuator should operate at that pressure developed in the system by the load on the hydraulic twister motor after accomplishing about 270° of turning and wire twisting and tightening. This particular sequencing arrangement of these two operations is believed to be novel and unobvious and is comprehended by this invention.

Once the ties have been cut, the twister can complete the full twisting formation of the joints. When the desired number of twists have been made as conventionally determined, for example, by a cam operated counter, the twisters are turned in the reverse direction to disengage the twisted joints and especially the curl at their ends from the twister shafts and hooks, and to reposition them for initiation of the next tying operation. At this point, the cycle is complete and baling head H retracts for recommencement of the normal baling operation.

It will be obvious to those skilled in the art to which this invention pertains that various modifications and changes of the preferred embodiment described and shown herein may be made without departing from the spirit and scope of this invention. Also, reversals such as turning over the wire puller nose and direction of swing of the wire guide arms are intended to be comprehended by this invention.

I claim:

1. Bale tying apparatus for use with a baler, said baler including a baling chamber having sides, a feed hopper having an opening into said chamber for delivering to said chamber material to be baled, a baling head having open sided slots in its face and reciprocable within said chamber and past said feed hopper opening to a forward position of extension, and means to reciprocate said head, said tying apparatus comprising wire dispensing means on opposite sides of said baler, wire guide means on opposite sides of said baler for guiding wires dispensed from said dispensing means and extending through said chamber on the forward side of the feed hopper opening and along each side of said chamber and a bale formed therein, a wire puller assembly mounted on one side of said chamber, including a longitudinal member long enough to reach across the baling chamber and between the wires extending along opposite sides of the baling chamber, means for extending and retracting said longitudinal member along a path through the slots in the baling head and across said chamber to and from said other side from and to said one side, and a nose on said longitudinal member for engaging said wire extending along said other side whereby retraction of said longitudinal member pulls wire from said dispensing means on said other side across said chamber and positions a length of wire drawn from said other side closely adjacent a corresponding length of wire on said one side, said nose on the front end of said longitudinal member having a downturned forward end extending lower than the level of the wires and a rear end standing higher than the level of the wires so that upon extension of said longitudinal member said downturned forward end of said nose lifts said wires and said longitudinal member passes under them without engagement, and upon retraction said rear end of said nose is engaged by said wires as encountered and pulled in the direction of retraction by said longitudinal member, a pair of rotatable twister means spaced apart and supported for rotation on said one side of said chamber and on opposite sides of said path of extension and retraction of said longitudinal member each for engagement of each with said wires at a point spaced from the other along said adjacent lengths thereof, means to rotate said twister means whereby said wires are twisted together for a distance from the point of engagement of each of said twister means, cutter means mounted on said one side of said chamber along said path of extension and retraction and between said spaced twister means for cutting both said wires in said adjacent lengths thereof and between the spaced points of engagement of said twister means, said wire guide means comprising guide arms positioned on each side of the path of extension and retraction of said longitudinal member and on each side of the baler for holding the wires at predetermined levels for the desired engagement by said longitudinal member, said arms pivotally connected to support means to permit said arms to swing and change the level of the wires guided by them as said longitudinal member is extended and said nose passes, resilient means urging said arms to swing back to their predetermined level after the passage of said nose and remain at said level as said longitudinal member is retracted.

2. Apparatus according to claim 1 in which said means for extending and retracting said wire puller comprises a tube supported horizontally and parallel to the intended path of extension and retraction of said wire puller, a crosshead slidable on said tube, means on said crosshead to support and connect to said wire puller, guide means for maintaining said crosshead in a predetermined plane during extension and retraction of said wire puller, means for driving said crosshead back and forth along said tube to extend and retract said wire puller.

3. Bale tying apparatus for use with a baler, said baler including a baling chamber having sides, a feed hopper having an opening into said chamber for delivering to said chamber material to be baled, a baling head having open sided slots in its face and reciprocable within said chamber and past said feed hopper opening to a forward position of extension, and means to reciprocate said head, said tying apparatus comprising wire dispensing means on opposite sides of said baler, wire guide means on opposite sides of said baler for guiding wires dispensed from said dispensing means and extending through said chamber on the forward side of the feed hopper opening and along each side of said chamber and a bale formed therein, a wire puller assembly mounted on one side of said chamber, including a longitudinal member long enough to reach across the baling chamber and between the wires extending along opposite sides of the baling chamber, means for extending and retracting said longitudinal member along a path through the slots in the baling head and across said chamber to and from said other side from and to said one side, and a nose on said longitudinal member for engaging said wire extending along said other side whereby retraction of said longitudinal member pulls wire from said dispensing means on said other side across said chamber and positions a length of wire drawn from said other side closely adjacent a corresponding length of wire on said one side, a pair of rotatable twister means spaced apart and supported for rotation on said one side of said chamber and on opposite sides of said path of extension and retraction of said longitudinal member each for engagement of each with said wires at a point spaced from the other along said adjacent lengths thereof, means to rotate said twister means whereby said wires are twisted together for a distance from the point of engagement of each of said twister means, cutter means mounted on said one side of said chamber along said path of extension and retraction and between said spaced twister means for cutting both said wires in said adjacent lengths thereof and between the spaced points of engagement of said twister means.

4. Apparatus according to claim 3 in which each of said pair of twister means rotates in a direction opposite to that of the other.

5. Apparatus according to claim 4 in which said twister means each comprise a shaft supported for rotation about an axis generally parallel to a portion of the adjacent lengths of said wires to be twisted by said twister means, a length of said shaft extending beyond the rotational supports being directed at a slight angle to the axis of rotation of said shaft, a curved hook attached to said angled length of shaft at a point off the shaft axis of rotation and directed to reach to the side of the shaft in the direction of rotation.

6. Apparatus according to claim 5 in which each of said curved hooks meets and engages said angled length of its supporting shaft at substantially a right angle and curves outwardly and away from its point of engagement in approximately a combination of a spiral concentric with the axis of said angled length of supporting shaft and a helix leading away from said rotational supports.

7. Bale tying apparatus for use with a baler, said baler including a baling chamber having sides, a feed hopper having an opening into said chamber for delivering to said chamber material to be baled, a baling head having open sided slots in its face and reciprocable within said chamber and past said feed hopper opening to a forward position of extension, and means to reciprocate said head, said tying apparatus comprising wire dispensing means on opposite sides of said baler, wire guide means on opposite sides of said baler for guiding wires dispensed from said dispensing means and extending through said chamber on the forward side of the feed hopper opening and along each side of said chamber and a bale formed therein, a wire puller assembly mounted on one side of said chamber, including a longitudinal member long enough to reach across the baling chamber and between the wires extending along opposite sides of the baling chamber, means for extending and retracting said longitudinal member along a path through the slots in the baling head and across said chamber to and from said other side from and to said one side, and a nose on said longitudinal member for engaging said wire extending along said other side whereby retraction of said longitudinal member pulls wire from said dispensing means on said other side across said chamber and positions a length of wire drawn from said other side closely adjacent a corresponding length of wire on said one side, a pair of rotatable twister means spaced apart and supported for rotation on said one side of said chamber and on opposite sides of said path of extension and retraction of said longitudinal member each for engagement of each with said wires at a point spaced from the other along said adjacent lengths thereof, means to rotate said twister means whereby said wires are twisted together for a distance from the point of engagement of each of said twister means, cutter means mounted on said one side of said chamber along said path of extension and retraction and between said spaced twister means for cutting both said wires in said adjacent lengths thereof and between the spaced points of engagement of said twister means, said wire puller having a central slot passing generally vertically through said longitudinal member, said slot extending in length to and between said nose and said means for extending and retracting said longitudinal member with said wires that are engaged and positioned by said nose passing across said slot, said cutter means standing vertically in said slot and in a fixed position relative to the extension and retraction of said longitudinal member whereby said longitudinal member is free to extend and retract, bringing together and to said cutter and in operative relationship thereto corresponding lengths of said wire extending along each side of said chamber for cutting where they pass across said slot.

8. The apparatus according to claim 7 in which said twisters are spaced apart on opposite sides of the path of extension and retraction of said wire puller within reach of said closely adjacent lengths of said wires when said wire puller is in a position of retraction placing said wires in an operative relationship with said cutter.

9. Apparatus sequencing the operation of said twister means and said cutter means in the apparatus according to claim 8 and in which said means for rotating said twister means and said cutter means are driven by hydraulic actuators adapted to be connected to a hydraulic system so that a load on one increases pressure in the system and available to the other, said twister means actuator being responsive to lower system pressure and said cutter means actuator being responsive to higher system pressure, whereby twisting may be initiated at said lower pressure by said twister means prior to cutting and continued until resistance to twisting imposes a load upon said twister means actuator and increases system pressure supplied said cutter means actuator to its higher pressure operating level and said cutter means is actuated.

10. Apparatus according to claim 9 in which said twisters rotate between one-half and one and one-half times before said cutter means are actuated to cut said wires.

* * * * *